US008834190B2

(12) United States Patent
Ngo et al.

(10) Patent No.: US 8,834,190 B2
(45) Date of Patent: Sep. 16, 2014

(54) ELECTRICAL CONNECTOR WITH LATCH

(75) Inventors: Hung Viet Ngo, Austin, TX (US); Robert E. Marshall, Elizabethtown, PA (US)

(73) Assignee: FCI Americas Technology LLC, Carson City, NV (US)

( * ) Notice: Subject to any disclaimer, the term of this patent is extended or adjusted under 35 U.S.C. 154(b) by 14 days.

(21) Appl. No.: 13/571,779

(22) Filed: Aug. 10, 2012

(65) Prior Publication Data

US 2013/0040483 A1 Feb. 14, 2013

Related U.S. Application Data

(60) Provisional application No. 61/523,076, filed on Aug. 12, 2011.

(51) Int. Cl.

| | |
|---|---|
| ***H01R 13/64*** | (2006.01) |
| ***H01R 12/70*** | (2011.01) |
| *H01R 13/514* | (2006.01) |
| *H01R 12/72* | (2011.01) |
| *H01R 12/75* | (2011.01) |

(52) U.S. Cl.

CPC ..... *H01R 12/7023* (2013.01); *H01R 13/514* (2013.01); *H01R 12/721* (2013.01); *H01R 12/75* (2013.01)

USPC ..... 439/328

(58) Field of Classification Search

USPC ..... 439/328, 636, 637, 325, 59, 157, 358

See application file for complete search history.

(56) References Cited

U.S. PATENT DOCUMENTS

| | | | | |
|---|---|---|---|---|
| 3,693,134 | A | 9/1972 | Trevisiol | |
| 3,970,353 | A | 7/1976 | Kaufman | |
| 5,167,523 | A * | 12/1992 | Crimmins et al. | 439/350 |
| 5,468,156 | A | 11/1995 | Flinchbaugh et al. | |
| 5,511,985 | A * | 4/1996 | Noschese et al. | 439/157 |
| 6,149,451 | A * | 11/2000 | Weber | 439/358 |
| 6,767,235 | B2 | 7/2004 | Wu | |
| 7,137,848 | B1 * | 11/2006 | Trout et al. | 439/465 |
| 7,188,408 | B2 * | 3/2007 | Korsunsky et al. | 29/831 |
| 7,239,529 | B1 | 7/2007 | Chang | |
| 7,892,015 | B2 * | 2/2011 | Li et al. | 439/358 |
| 8,323,049 | B2 * | 12/2012 | Ngo | 439/552 |
| 2002/0119704 | A1 | 8/2002 | Ito et al. | |
| 2004/0097118 | A1 * | 5/2004 | Takashita | 439/327 |
| 2006/0141849 | A1 * | 6/2006 | Trout | 439/465 |
| 2006/0189195 | A1 | 8/2006 | Okada | |
| 2008/0305682 | A1 * | 12/2008 | Wu | 439/604 |
| 2009/0104818 | A1 | 4/2009 | Wu et al. | |

* cited by examiner

*Primary Examiner* — Alexander Gilman

(74) *Attorney, Agent, or Firm* — Baker & Hostetler LLP

(57) ABSTRACT

An electrical connector may retain a substrate in secure, mating engagement with the electrical connector. The electrical connector can include at least one attachment member that is configured to be received in an aperture that extends through the substrate.

23 Claims, 7 Drawing Sheets

ELECTRICAL CONNECTOR WITH LATCH

CROSS-REFERENCE TO RELATED APPLICATIONS

This claims the benefit of U.S. Patent Application Ser. No. 61/523,076, filed Aug. 12, 2011, the disclosure of which is hereby incorporated by reference as if set forth in its entirety herein.

BACKGROUND

Electrical connectors can be configured to be mated with a complementary electrical component, such as a substrate. Typically, a substrate carries a plurality of electrical contact pads along opposed sides proximate to a leading edge of the substrate. The electrical connector can carry a plurality of electrical contacts configured to abut the electrical contact pads on the substrate when the electrical connector is mated to the substrate, thereby placing the electrical connector into electrical communication with the substrate. Although the electrical contact pads on a substrate can be received between resilient mating ends of the electrical contacts carried by the electrical connector, it may nevertheless be desirable to provide additional mechanisms for securing and/or maintaining mating engagement between the receptacle connector and the substrate.

SUMMARY

In accordance with one embodiment, an electrical cable connector is configured to be mated to a substrate along a mating direction. The electrical connector can include a connector housing that defines a housing body that has a front end that defines a mating interface. The connector housing can further define receptacle that extends into the front end so as to at least partially define mating interface. The receptacle is sized to receive a front edge of the substrate. The connector housing can define a pocket that extends into the housing body and defines a base that at least partially defines the pocket. The electrical connector can further include a plurality of electrical contacts carried by the connector housing. The electrical contacts can define mating ends that are configured to electrically connect to electrical contact pads carried by at least one of top and bottom surfaces of the substrate when the mating interface receives the substrate. The electrical contacts can further define mounting ends that are disposed opposite the mating ends and are configured to electrically connect to respective cables. The electrical connector can further include at least one latch member at least partially disposed in the pocket, the latch member including a latch arm that carries a lock member. The latch member is movable in 1) an attachment direction that causes the lock member to move into the aperture when the substrate is fully received in the receptacle, and 2) a detachment direction that removes the lock member from the aperture.

BRIEF DESCRIPTION OF THE DRAWINGS

The foregoing summary, as well as the following detailed description of the preferred embodiments of the application, will be better understood when read in conjunction with the appended drawings. For the purposes illustration, there are shown in the drawings preferred embodiments. It should be understood, however, that the instant application is not limited to the precise arrangements and/or instrumentalities illustrated in the drawings, in which.

DETAILED DESCRIPTION

Figure 1A:
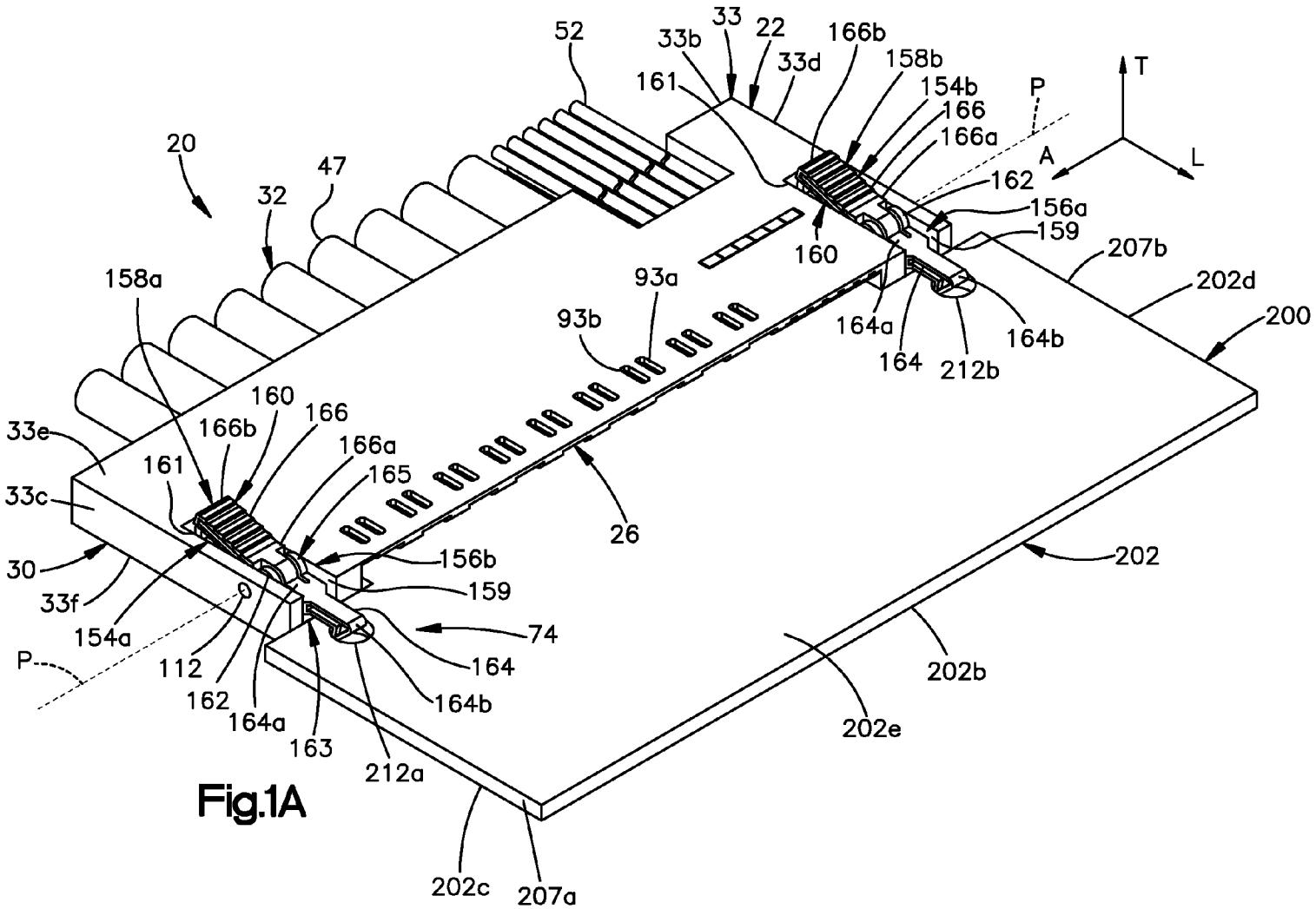
FIG. 1A is a perspective view of an electrical connector assembly that includes a substrate, a cable assembly, and an electrical connector that is configured to be mounted to the cable assembly and mated to the substrate in accordance with an embodiment.

For convenience, the same or equivalent elements in the various embodiments illustrated in the drawings have been identified with the same reference numerals. Certain terminology is used in the following description for convenience only and is not limiting. The words "left", "right", "front", "rear", "upper," and "lower" designate directions in the drawings to which reference is made. The words "forward", "forwardly", "rearward", "inner," "inward," "inwardly," "outer," "outward," "outwardly," "upward," "upwardly," "downward," and "downwardly" refer to directions toward and away from, respectively, the geometric center of the object referred to and designated parts thereof. The terminology intended to be non-limiting includes the above-listed words, derivatives thereof and words of similar import.

Figure 1B:
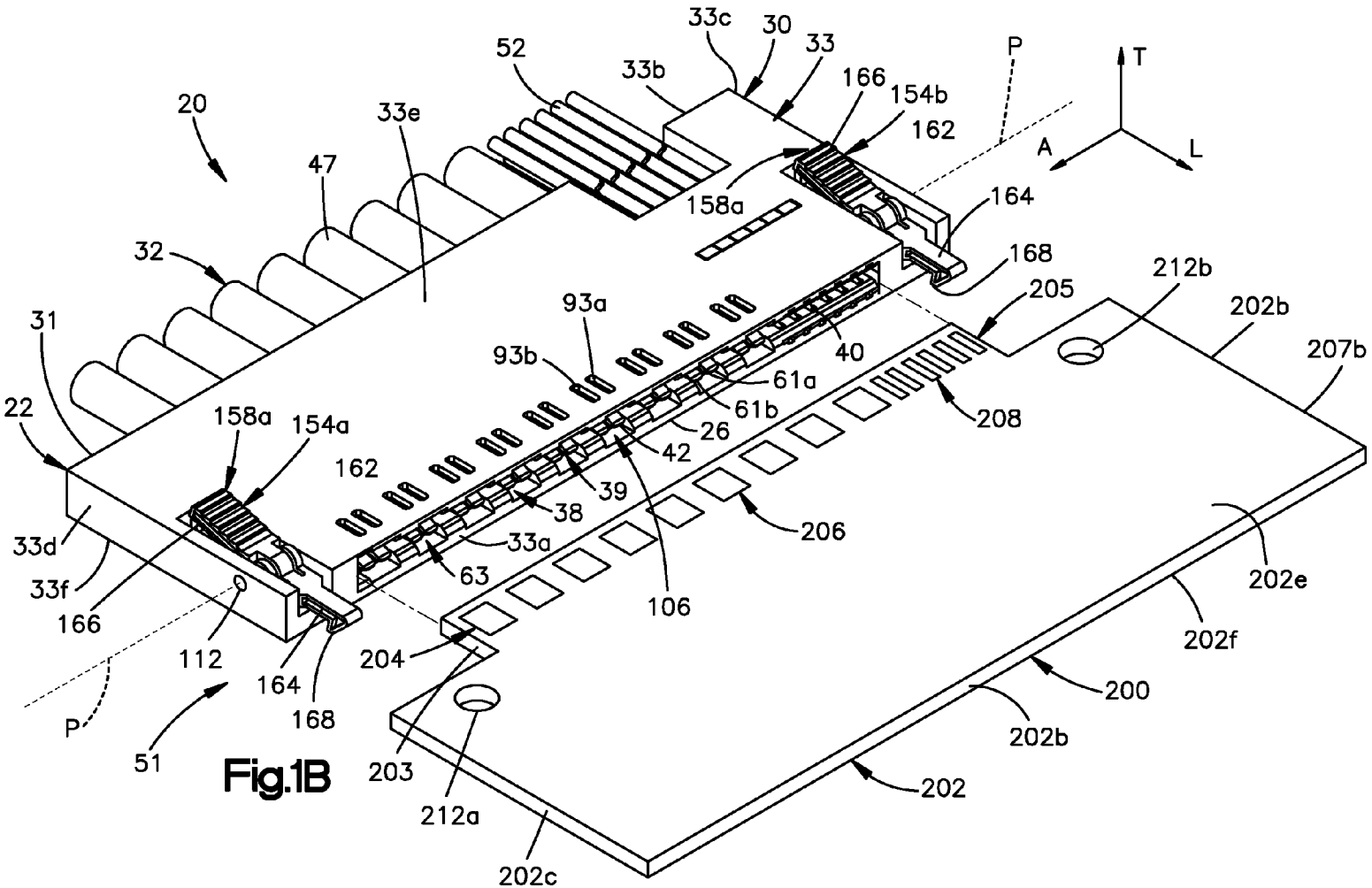
FIG. 1B is an exploded perspective view of the electrical connector assembly, showing the substrate exploded from the electrical connector.

Referring initially to FIGS. 1A-B, in accordance with one embodiment, an electrical connector assembly 20 includes an electrical connector 22 that is configured to be mated to a complementary electrical component in the form of a substrate 200, which can be configured as a printed circuit board in accordance with the illustrated embodiment. In accordance with the illustrated embodiment, the electrical connector 22 is configured as an electrical cable connector. The electrical connector 22 includes a dielectric or electrically insulative connector housing 30 and a plurality of electrical contacts 38 that are supported by the connector housing 30. The electrical connector 22 defines a mounting interface 31 that is configured to be mounted onto the cable assembly 32, thereby placing the plurality of electrical contacts 38 in electrical communication with the cable assembly 32.

The electrical connector 22 further defines a mating interface 26. The electrical connector 22 is configured to mate with the substrate 200, thereby placing the plurality of electrical contacts 38 in electrical communication with electrical contact pads 204 of the substrate 200 (see FIG. 3), and electrical traces that are carried by the substrate 200. As will be described in more detail below, the electrical connector assembly 20 can include an attachment assembly 74, which can be configured as a latch assembly. For instance, the electrical connector 22 can include at least one engagement member such as a pair of engagement members, such as a first attachment member 154*a* and a second attachment member 154*b*. The substrate 200 can similarly include at least one engagement member such as a first attachment member 211*a* and a second attachment member 211*b*. Thus, the attachment assembly 74 includes the first and second attachment members 154*a-b* of the electrical connector 22, and the first and second attachment members 211*a-b* of the substrate 200. The first and second attachment members 154*a-b* are configured to mate with the first and second attachment members 211*a-b*, so as to secure the substrate 200 to the electrical connector 22 when the electrical connector 22 is mated with the substrate 200 as illustrated in FIG. 1A.

Various structures are described herein as extending horizontally along a longitudinal direction "L" and lateral direction "A" that is substantially perpendicular to the longitudinal direction L, and vertically along a transverse direction "T" that is substantially perpendicular to the longitudinal and lateral directions L and A, respectively. As illustrated, the longitudinal direction "L" extends along a forward/rearward direction of the electrical connector assembly 20, and defines a mating direction M along which the first electrical connector 22 is moved so as to mate with the substrate 200. The lateral direction "A" extends along a width the first electrical connector 22, and the transverse direction "T" extends along a height of the first electrical connector 22. Thus, unless otherwise specified herein, the terms "lateral,""longitudinal," and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described.

It should be appreciated that while the longitudinal and lateral directions are illustrated as extending along a horizontal plane, and that the transverse direction is illustrated as extending along a vertical plane, the planes that encompass the various directions may differ during use, depending, for instance, on the orientation of the various components. Accordingly, the directional terms "vertical" and "horizontal" are used to describe the electrical connector assembly 20 and its components as illustrated merely for the purposes of clarity and convenience, it being appreciated that these orientations may change during use.

The connector housing 30 includes a housing body 33 that defines a front end 33*a* and an opposed rear end 33*b* spaced from the front end 33*a* along the longitudinal direction L, first and second opposed sides 33*c* and 33*d* that are spaced from each other along the lateral direction A, and a top end 33*e* and an opposed bottom end 33*f* that is spaced from the top end 33*e* along the transverse direction T. The front end 33*a* of the housing body 33 can define the mating interface 26 of the electrical connector 22, and the rear end 33*b* can define the mounting interface 31 of the electrical connector 22. Accordingly, the mating interface 26 and the mounting interface 31 are oriented substantially parallel to each other in accordance with the illustrated embodiment, and the electrical connector 22 can be referred to as a vertical electrical connector. It should be appreciated, however, that the electrical connector can alternatively be a right-angle connector, whereby the mating interface 26 and the mounting interface 31 are oriented substantially perpendicular to each other.

With continuing reference to FIGS. 1A-B, the plurality of electrical contacts 38 can include at least one electrical signal contact 40 such as a plurality of electrical signal contacts 40, and at least one electrical power contact 42 such as a plurality of electrical power contacts 42. In accordance with the illustrated embodiment, the electrical power contacts 42 are disposed adjacent the first side 33*c*, and the electrical signal contacts 40 are disposed adjacent the second side 33*d*. Accordingly, the electrical signal contacts 40 can be disposed between the electrical power contacts 42 and the second side 33*d*, and the electrical power contacts 42 can be disposed between the electrical signal contacts 40 and the first side 33*c*. In accordance with alternative embodiments, the electrical connector can be devoid of electrical signal contacts 40, such that the plurality of electrical contacts 38 includes only electrical power contacts 42. Alternatively still, the electrical connector 22 can be devoid of electrical power contacts 42, such that the plurality of electrical contacts 38 includes only electrical signal contacts 40.

The plurality of electrical contacts 38 can define mating ends 39 that are configured to mate with the electrical contact pads 204 of the substrate so as to mate the electrical connector 22 with the substrate. The mating ends 39 of the plurality of electrical contacts 38 can be arranged in at least one row such as a first or upper row 61*a* and a second or lower row 61*b* that is spaced from the upper row 61*a* along the transverse direction T, so as to define a gap 63 that extends along the transverse direction T between the upper row 61*a* and the lower row 61*b*. Each of the upper and lower rows 61*a* and 61*b* extends along a row direction 51, which can be defined as the lateral direction A in accordance with the illustrated embodiment. Accordingly, the electrical contacts 38 of each row are spaced from each other along the lateral direction A. The front end 33*a* of the housing body 33, and in particular the opposed top and bottom ends 33*e* and 33*f*, and the opposed first and second sides 33*c* and 33*d* at the front end 33*a*, can define a receptacle 106 that extends into the front end 33*a* so as to at least partially define the mating interface 26. The receptacle 106 is configured to receive a portion, such as a front or leading edge 202*a* of the substrate 200 (see FIG. 3) when the electrical connector 22 is are mated to the substrate, such that the gap 63 receives a mating interface 205 of the substrate 200, that includes the leading edge 202*a*, thereby placing the plurality of electrical contacts 38 in electrical communication with the electrical contact pads 204 that are carried by the substrate body 202 at the mating interface 205 in accordance with the illustrated embodiment. Thus, the electrical connector 22 can be referred to as an edge-card connector. Further, because the electrical connector 22 is configured to receive the substrate 200 so as to mate the electrical connector 22 with the substrate 200, the electrical connector 22 can be referred to as a receptacle connector in accordance with the illustrated embodiment. Furthermore, it should be appreciated that the mating ends 39 of the electrical contacts 38 are configured to straddle opposed top and bottom sides of the substrate 200 when the electrical connector 22 is mated with the substrate 200.

Referring now to FIGS. 1A-2D, each of the plurality of electrical contacts 38 defines a mounting end that is configured to be attached to the first complementary electrical device. For instance, each of the electrical signal contacts 40 defines a mounting end 65 that is configured to be mounted to at least one complementary signal cable 52 so as to define a corresponding plurality of signal contact assemblies 46. Furthermore, each of the electrical power contacts 42 defines a mounting end 67 that is configured to be mounted to at least one complementary power cable 47 so as to define a corresponding plurality of power contact assemblies 44. In accordance with the illustrated embodiment, the mating ends 39 of the plurality of electrical contacts 38 are disposed proximate to the mating interface 26, and thus proximate to the front end 33*a* of the housing body 33. Further, in accordance with the illustrated embodiment, the mounting ends of the plurality of electrical contacts 38 are disposed proximate to the mounting interface 31, and thus proximate to the rear end 33*b* of the housing body. Accordingly, the mating ends 39 are oriented substantially parallel to the mounting ends of the plurality of electrical contacts 38, and the plurality of electrical contacts 38 can be referred to as vertical electrical contacts. It should be appreciated, however, that the plurality of electrical contacts 38 can be configured as right-angle electrical contacts whereby the mating ends 39 of the plurality of electrical contacts 38 are oriented substantially perpendicular to each other. For instance, the mating ends 39, and thus the mating interface 26, can be disposed proximate the front end 33*a* of the housing body 33, and the mounting ends of the plurality of electrical contacts 38, and thus the mounting interface 31, can be disposed proximate the bottom end 33*f* of the housing body 33.

Figure 2A:
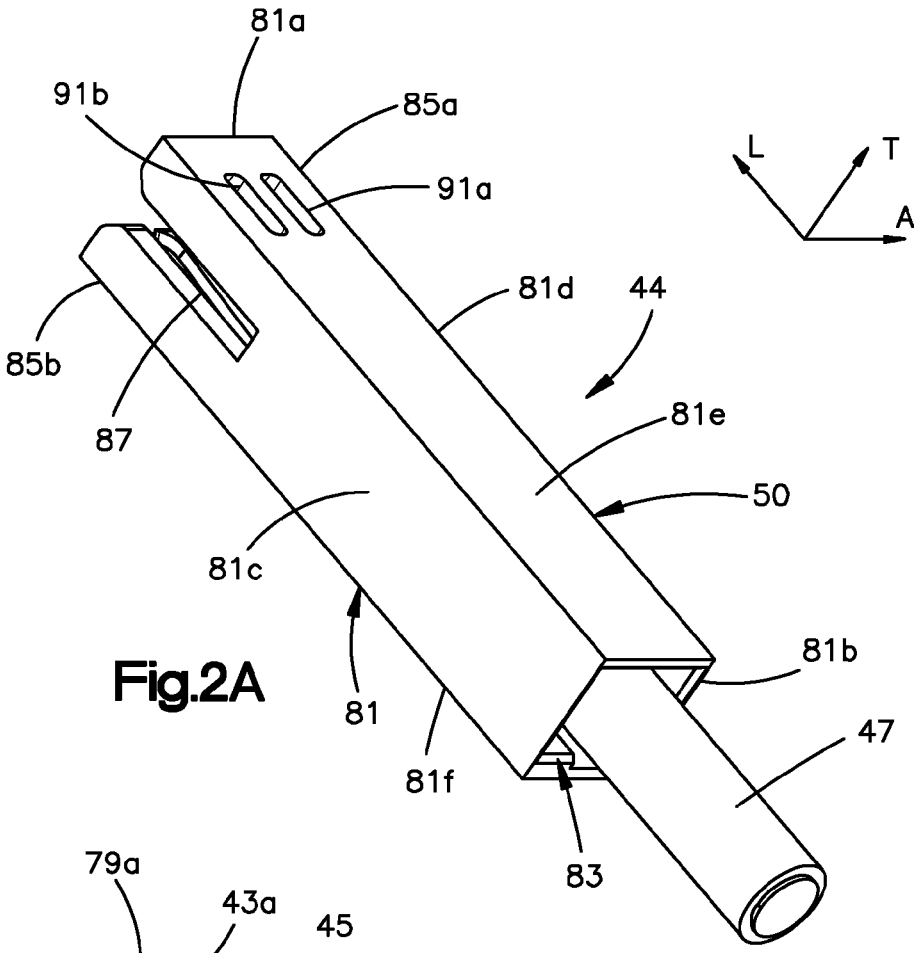
FIG. 2A is a perspective view of a power contact assembly of the electrical connector illustrated in FIG. 1.
Figure 2B:
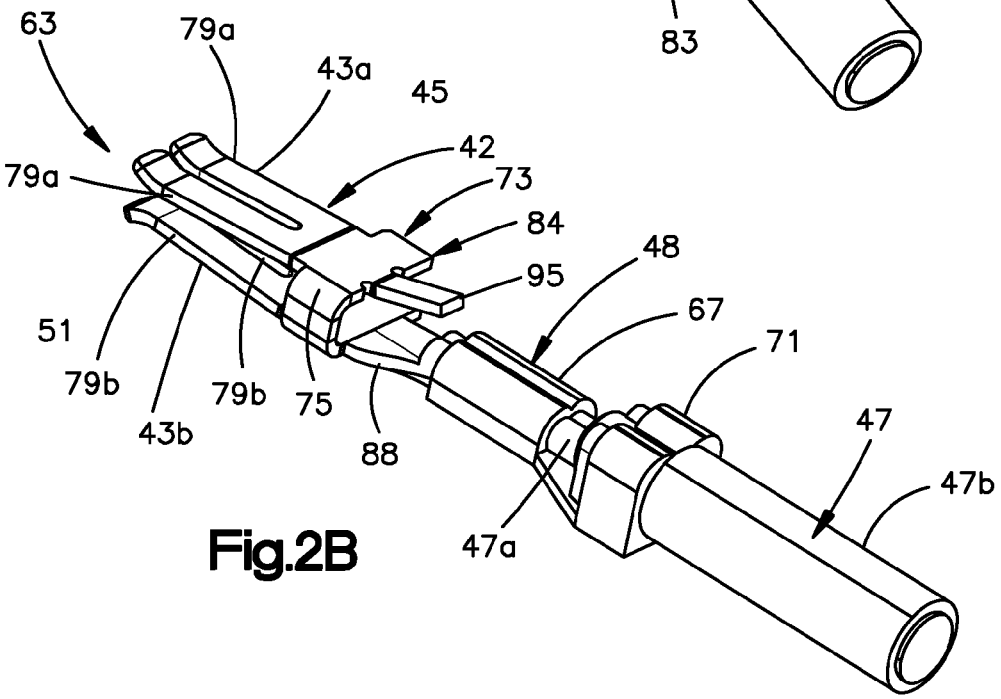
FIG. 2B is a perspective view of a portion of the power contact assembly illustrated in FIG. 2A.

Referring now to FIGS. 2A-B in particular, each power contact assembly 44 can include a power cable 47 and at least one electrical power contact 42 that is crimped or otherwise attached to the power cable 47 at an interface 48 between each respective mounting end 67 and a complementary one of the power cables 47, so as to place the electrical power contact 42 and the power cable 47 in electrical communication. For instance, each power cable 47 includes an electrically conductive portion, such as an electrically conductive wire 47*a*, and an electrically insulative portion, such as an electrically insulative sheath 47*b*, that surrounds the wire 47*a*. The mounting ends 67 of the electrical power contacts 42 can be crimped about the wire 47*a* of the complementary power cable 47 so as to place the power cable 47 in electrical communication with the corresponding electrical power contact 42. Each electrical power contact 42 can further include a strain relief member 71 that is disposed rearward of the mounting end 67, and can be attached to the complementary power cable. For instance, the strain relief member 71 can be crimped about the sheath 47*b*, such that a majority of a rearwardly directed tensile force applied to the power cable 47 at a location rearward of the strain relief member 71 is absorbed at an interface between the strain relief member and the sheath 47*b*. Thus, the majority of the rearwardly directed tensile force is isolated from the interface 48 between the mounting end 67 and the wire 47*a*.

The electrical power contacts 42 can each include a contact body 84 that defines A mating end 45, the mounting end 67 that includes at least one first or upper beam 43*a* and at least one second or lower beam 43*b*, a lead portion 73 that is connected between the mating end 45 and the mounting end 67, and the strain relief member 71. In accordance with the illustrated embodiment, the mating end 45, the mounting end 67, the lead portion 73, and the strain relief member 71 are integral and monolithic with each other. The lower beam 43*b* is spaced from the upper beam 43*a* along the transverse direction T, such that the upper beam 43*a* is disposed in the upper row 61*a* and the lower beam 43*b* is disposed in the lower row 61*b* (see FIG. 1B), and the gap 63 is disposed between the upper and lower beams 43*a* and 43*b*. The lead portion 73 can include a strap 75 that is attached between the upper and lower beams 43*a* and 43*b* so as to support the upper and lower beams 43*a* and 43*b* in the respective upper and lower rows 61*a* and 61*b*. The lead portion 73 can further include a neck 88 that extends from the mounting end 67 to the strap 75, for instance at a location substantially aligned with the lower beam 43*b*, such that the neck 88 extends from the strap 75 and attaches to both the lower beam 43*b* and the upper beam 43*a*.

Each of the upper and lower beams 43*a* and 43*b* can be cantilevered from the lead portion 73, and in particular from the strap 75. At least a first portion, such as a rear portion, of the upper beams 43*a* can extend toward the lower beams 43*b*, and a second portion, such as a front portion, of the upper beams 43*a* can extend away from the lower beams 43*b*. Similarly, at least a first portion, such as a rear portion, of the lower beams 43*b* can extend toward the upper beams 43*a*, and a second portion, such as a rear portion, of the lower beams 43*b* can extend away from the upper beams 43*a*. The front end of the upper and lower beams 43*a* and 43*b* can be split as desired such that each of the upper and lower beams 43*a* and 43*b* defines first and second fingers 79*a* and 79*b*, respectively, that are spaced from each other along the row direction 51.

Each power contact assembly 44 can include an electrically insulative power contact retainer 50 that supports the power cable 47 and the electrical power contact 42. For instance, the power contact retainer 50 can include a body 81 that defines a front end 81*a* and an opposed rear end 81*b* that is spaced from the front end 81*a* along the longitudinal direction L, first and second opposed sides 81*c* and 81*d* that are spaced from each other along the lateral direction A, and a top end 81*e* and an opposed bottom end 81*f* that is spaced from the top end 81*e* along the transverse direction T. The power contact retainer 50 can be supported by the connector housing 30 such that the front end 81*a* is disposed proximate to the mating interface 26 of the electrical connector 22, and the rear end 81*b* is disposed proximate to the mounting interface 31 of the electrical connector 22.

The power contact retainer 50 can define an opening 83 that extends forward through the rear end 81*b* of the body 81 along the longitudinal direction L toward the front end 81*a*. The power contact retainer 50 further includes upper and lower opposed retainer arms 85*a* and 85*b* that extend forward from the body 81, for instance from the front end 81*a*, along the longitudinal direction L. Each of the upper and lower retainer arms 85*a* and 85*b* can define a surface that faces the other of the upper and lower retainer arms 85*a* and 85*b*, and defines a pocket 87 that extends into the surface along the transverse direction T, such that at least a first portion of the respective upper and lower beams 43*a* and 43*b* is at least partially disposed in the respective pockets 87, and a second portion of the respective upper and lower beams 43*a* and 43*b* protrudes from the respective surface toward the opposed ones of the upper and lower retainer arms 85*a* and 85*b*.

The power contact retainer 50 can further define at least one heat dissipation window that can extend through at least one such as both of the upper and lower retainer arms 85*a* and 85*b* along the transverse direction T, and can be aligned with the respective electrical power contact 42, for instance at the mating end 45. In accordance with the illustrated embodiment, the power contact retainer 50 defines first and second heat dissipation windows 91*a* and 91*b* that extends through each of the upper and lower retainer arms 85*a* and 85*b* along the transverse direction T in at least partial alignment, such as alignment, with the first and second fingers 79*a* and 79*b*, respectively. For instance, the first and second heat dissipation windows 91*a* and 91*b* that extend through the upper retainer arm 85*a* can be aligned with the first and second fingers 79*a* and 79*b* of the upper beam 43*a*, and the first and second heat dissipation windows 91*a* and 91*b* that extend through the lower retainer arm 85*b* can be aligned with the first and second fingers 79*a* and 79*b* of the lower beam 43*b*.

The first and second heat dissipation windows 91*a* and 91*b* that extend through the upper and lower retainer arms 85*a* and 85*b* can further be aligned with respective first and second heat dissipation windows 93*a* and 93*b* that extend through the housing body 33 of the connector housing 30 (see FIG. 1B), and can extend for instance through the top and bottom ends 33*e* and 33*f* of the housing body 33 along the transverse direction T. Accordingly, during operation, heat disposed at the mating ends 45 of the electrical power contacts 42 can travel through the first and second heat dissipation windows 91*a* and 91*b*, and further through the first and second heat dissipation windows 93*a* and 93*b*, respectively, and out the connector housing 30.

Accordance with the illustrated embodiment, the electrical power contacts 42 and power cables 47 can be inserted into the power contact retainer 50 after the mounting end 67 has been attached to the power cable 47. For instance, with continuing reference to FIGS. 2A-B, each of the electrical power contacts 42 can include at least one retention flange 95 that resiliently extends from the contact body 84 rearward along the longitudinal direction L and up along the transverse direction T. For instance, the retention flange 95 can extend from the strap 75, and is configured to mate with a complementary recess disposed in the body 81 of the power contact retainer 50 as the electrical power contacts 42 are inserted forward along the longitudinal direction L through the opening 83 of the rear end 81*b* of the body 81 until the mating end 45 is disposed in the respective pocket 87, and the complementary power cable 47 extends rearward along the longitudinal direction L out the opening 83. Alternatively, the electrical power contacts 42 can be overmolded by the respective power contact retainers 50. The power contact assemblies 44 can then be installed in the connector housing 30 by securing the power contact retainers 50 in the housing body 33.

Figure 2C:
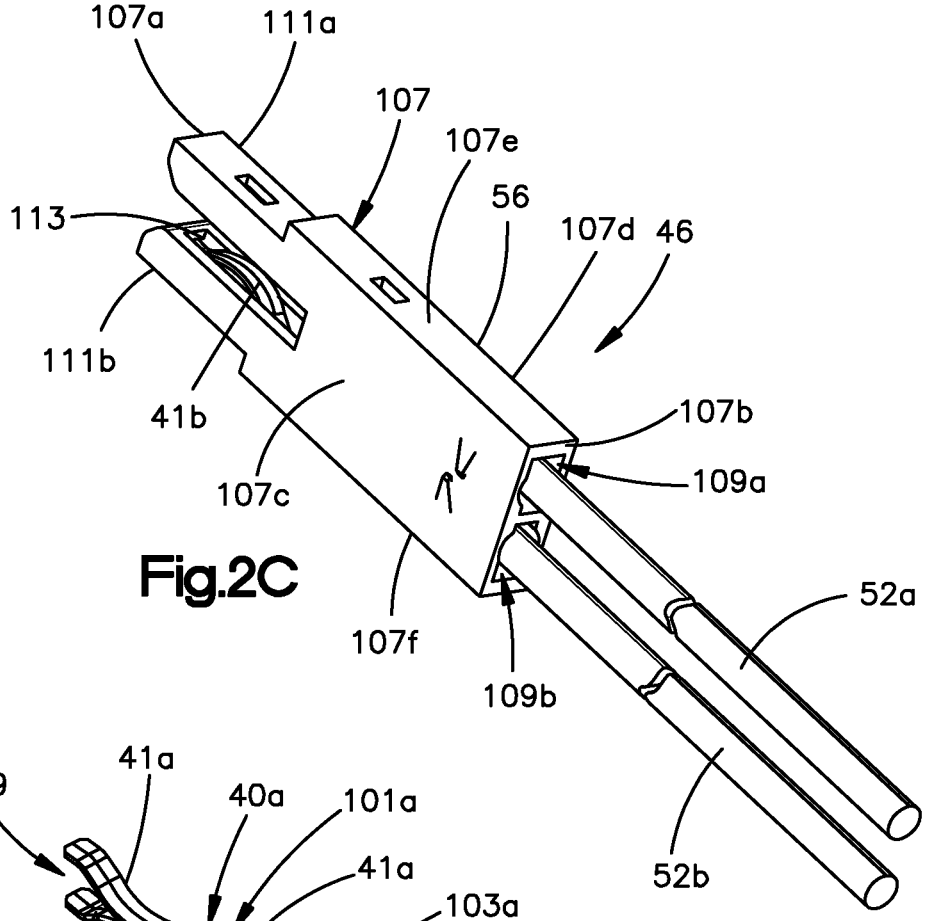
FIG. 2C is a perspective view of a signal contact assembly of the electrical connector illustrated in FIG. 1.
Figure 2D:
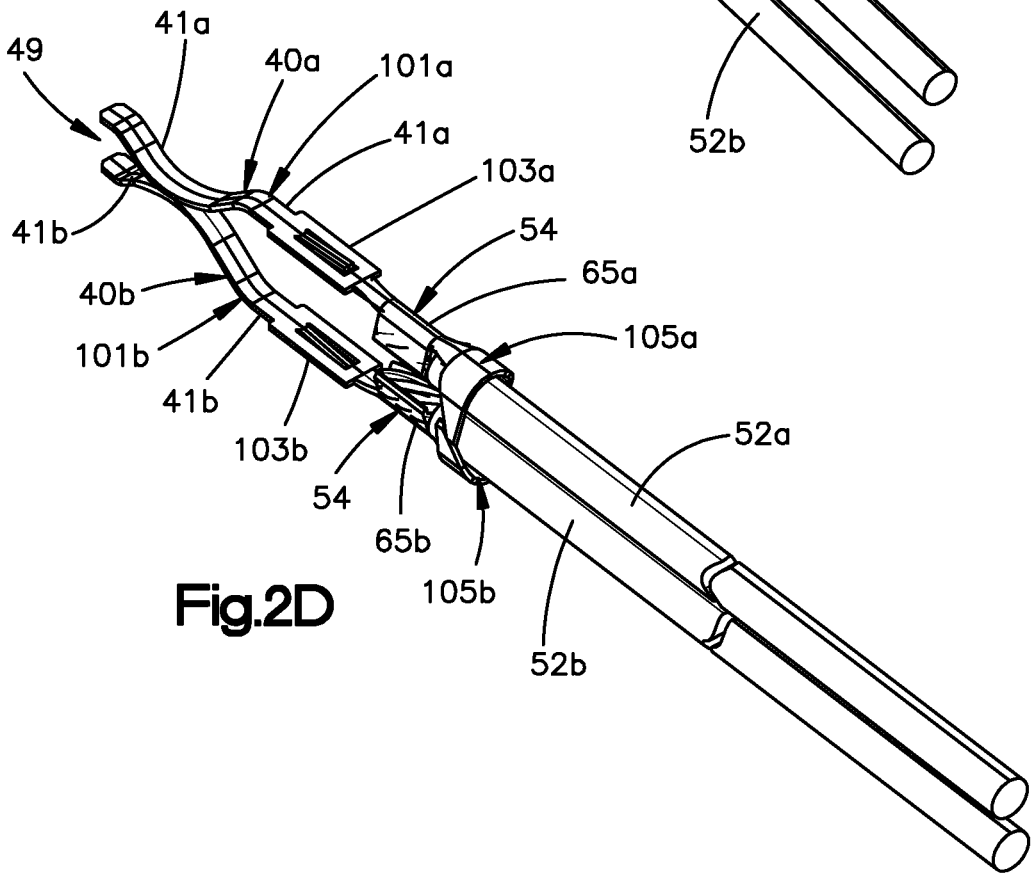
FIG. 2D is a perspective view of a portion of the signal contact assembly illustrated in FIG. 2C.

Referring now to FIGS. 2C-D, each signal contact assembly 46 can include at least one signal cable 52 and a corresponding at least one electrical signal contact 40 that is crimped or otherwise secured to the at least one signal cable 52 at an interface 54, so as to place at least one electrical signal contact 40 and the signal cable 52 in electrical communication. Each signal contact assembly 46 can further include a signal contact retainer 56 that supports the at least one signal cable 52 and the corresponding at least one electrical signal contact 40. In accordance with the illustrated embodiment, the signal contact assembly 46 includes a first or upper signal cable 52*a* and a second or lower signal cable 52*b* that is spaced from the upper signal cable 52*a* along the transverse direction T, and a corresponding first or upper electrical signal contact 40*a* and a second or lower electrical signal contact 40*b* that is spaced from the upper electrical signal contact 40*a* along the transverse direction T. The upper electrical signal contact 40*a* is configured to be mounted to the upper signal cable 52*a*, and the lower electrical signal contact 40*b* is configured to be mounted to the lower signal cable 52*b*. Unless otherwise indicated, reference to the electrical signal contacts 40 and the signal cables 52, and components thereof, refers to both the upper and lower electrical signal contacts 40*a* and 40*b*, and the upper and lower signal cables 52*a* and 52*b*, and components thereof, respectively.

In accordance with the illustrated embodiment, each of the upper electrical signal contacts 40*a* can include a respective upper contact body 101*a* that defines an upper mating end 41*a*, an upper mounting end 65*a*, and an upper lead portion 103*a* that extends between the upper mounting end 65*a* and the upper mating end 41*a*. Each of the upper electrical signal contacts 40*a* can further include an upper strain relief member 105*a* that extends rearward from the upper mounting end 65*a* along the longitudinal direction L. Similarly, each of the lower electrical signal contacts 40*b* can include a respective lower contact body 101*b* that defines a lower mating end 41*b*, a lower mounting end 65*b*, and a lower lead portion 103*b* that extends between the lower mounting end 65*b* and the lower mating end 41*b*. Each of the lower electrical signal contacts 40*b* can further include lower strain relief member 105*b* that extends rearward from the lower mounting end 65*b* along the longitudinal direction L. In accordance with the illustrated embodiment, the upper and lower mating ends 41*a-b*, the upper and lower mounting ends 65*a-b*, lead portion 73, and the strain relief member 105 are integral and monolithic with each other.

Each signal cable 52 includes an electrically conductive portion, such as an electrically conductive wire, and an electrically insulative portion, such as an electrically insulative sheath that surrounds the wire. The mounting ends 65 of the electrical signal contacts 40 can be crimped about the wire of the complementary signal cable 52 so as to place the wire in electrical communication with the respective electrical signal contact 40. The strain relief member 105 can be attached to the complementary signal cable 52. For instance, the strain relief member 105 can be crimped about the sheath, such that a majority of a rearwardly directed tensile force applied to the signal cable 52 at a location rearward of the strain relief member 105 is absorbed at an interface between the strain relief member 105 and the sheath. Thus, the majority of the rearwardly directed tensile force is isolated from the interface 54 between the mounting end 65 and the wire.

The upper electrical signal contacts 40*a* are spaced from the lower electrical signal contacts 40*b* along the transverse direction T, such that the upper electrical signal contact 40*a* is disposed in the upper row 61*a* and the lower electrical signal contact 40*b* is disposed in the lower row 61*b* (see FIG. 1B), and the gap 63 is disposed between the upper and lower electrical signal contacts 40*a* and 40*b*.

Each of the mating ends 41 can be cantilevered from the lead portion 103, such that at least a first portion, such as a rear portion, of the upper mating ends 41*a* can extend toward the lower mating ends 41*b*, and a second portion, such as a front portion, of the upper mating ends 41*a* can extend away from the lower mating ends 41*b*. Similarly, at least a first portion, such as a rear portion, of the lower mating ends 41*b* can extend toward the upper mating ends 41*a*, and a second portion, such as a rear portion, of the lower mating ends 41*b* can extend away from the upper mating ends 41*a*.

Each signal contact assembly 46 can include an electrically insulative signal contact retainer 56 that supports one of the upper signal cables 52*a* and one of the lower signal cables 52*b* that is aligned with the one of the upper signal cables 52*a* along the transverse direction T. For instance, the signal contact retainer 56 can include a body 107 that defines a front end 107*a* and an opposed rear end 107*b* that is rearwardly spaced from the front end 107*a* along the longitudinal direction L, first and second opposed sides 107*c* and 107*d* that are spaced from each other along the lateral direction A, and a top end 107*e* and an opposed bottom end 107*f* that is downwardly spaced from the top end 107*e* along the transverse direction T. The signal contact retainer 56 can be supported by the connector housing 30 such that the front end 107*a* is disposed proximate to the mating interface 26 of the electrical connector 22, and the rear end 107*b* is disposed proximate to the mounting interface 31 of the electrical connector 22.

The signal contact retainer 56 can define at least one opening that extends Forward through the rear end 107*b* of the body 81 along the longitudinal direction L toward the front end 107*a*. For instance, the signal contact retainer 56 can define an upper opening 109*a* and a lower opening 109*b* that is spaced from the upper opening 109*a* along the transverse direction. The signal contact retainer 56 further includes upper and lower opposed retainer arms 111*a* and 111*b* that extend forward from the body 107, for instance from the front end 107*a*, along the longitudinal direction L. Each of the upper and lower retainer arms 111*a* and 111*b* can define a surface that faces the other of the upper and lower retainer arms 111*a* and 111*b*, and defines a pocket 113 that extends into the surface along the transverse direction T, such that at least a first portion of the respective upper and lower mating ends 41*a* and 41*b* is at least partially disposed in the respective pockets 113, and a second portion of the respective upper and lower mating ends 41*a* and 41*b* protrudes from the respective surface toward the opposed ones of the upper and lower retainer arms 111*a* and 111*b*.

Accordance with the illustrated embodiment, the electrical power contacts 42 and power cables 47 can be inserted into the power contact retainer 50 after the mounting end 67 has been attached to the power cable 47. Alternatively, the electrical power contacts 42 can be overmolded by the respective power contact retainers 50. The power contact assemblies 44 can then be installed in the connector housing 30 by securing the power contact retainers 50 in the housing body 33. It should be further appreciated that the mating ends 39 of the plurality of electrical contacts 38 can include either or both of the mating ends 45 of the electrical power contacts 42 and the mating ends 41 of the electrical signal contacts 40, and that the mounting ends of the plurality of electrical contacts 38 can include either or both of the mounting ends 67 of the electrical power contacts 42 and the mounting ends 65 of the plurality of electrical signal contacts 40.

It should be appreciated that the power cables 47 and the signal cables 52 can have different gauges or diameters. For instance, the power cables 47 can each define a first diameter and the signal cables 52 can each define a second diameter that is less than the first diameter. Accordingly, the mounting interface 31 of the electrical connector 22 is configured to receive, and mount to, the power cables 47 that define the first diameter and the signal cables 52 that define the second diameter. Similarly, the mounting ends of the electrical signal contacts 40 and the mounting ends of the electrical power contacts 42 are configured to be attached to the power cables 47 that define the first diameter and the signal cables 52 that define the second diameter.

Figure 3:
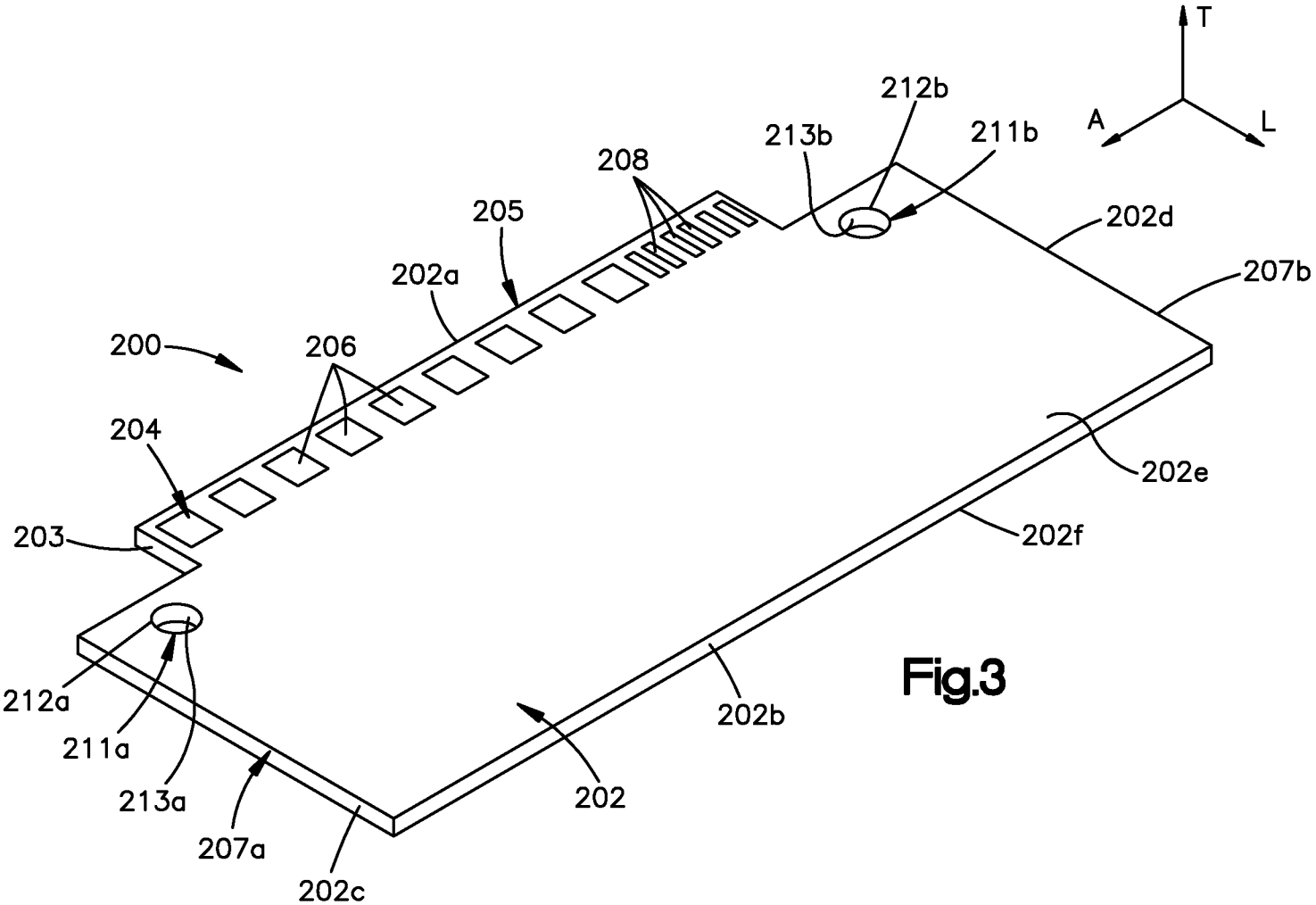
FIG. 3 is a perspective view of the substrate illustrated in FIG. 1.
Figure 4A:
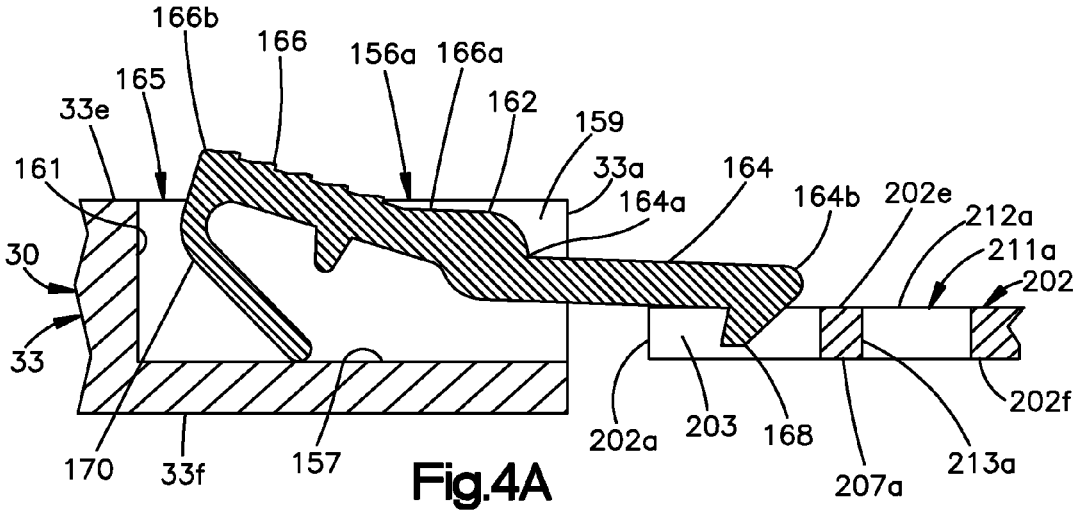
FIG. 4A is a sectional side elevation view showing attachment of a latch member of the electrical connector to the substrate as the electrical connector is mated with the substrate.
Figure 4B:
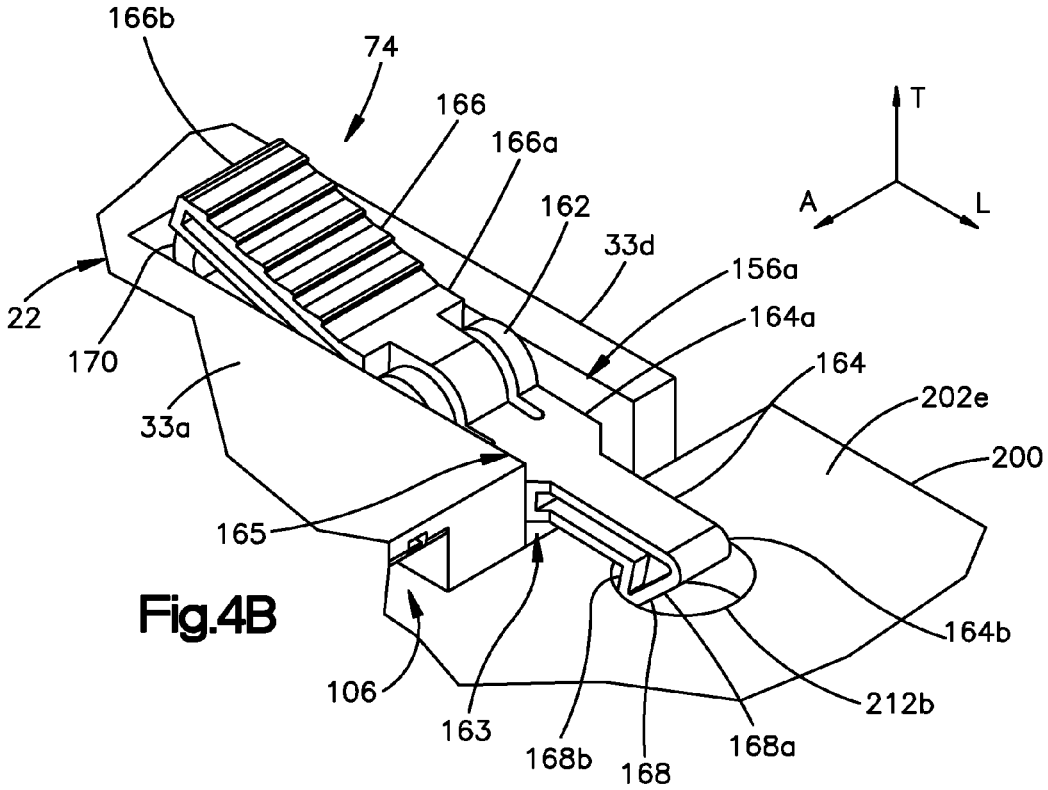
FIG. 4B is a top perspective view showing the latch member of the electrical connector attached to the substrate as illustrated in FIG. 4A.
Figure 4C:
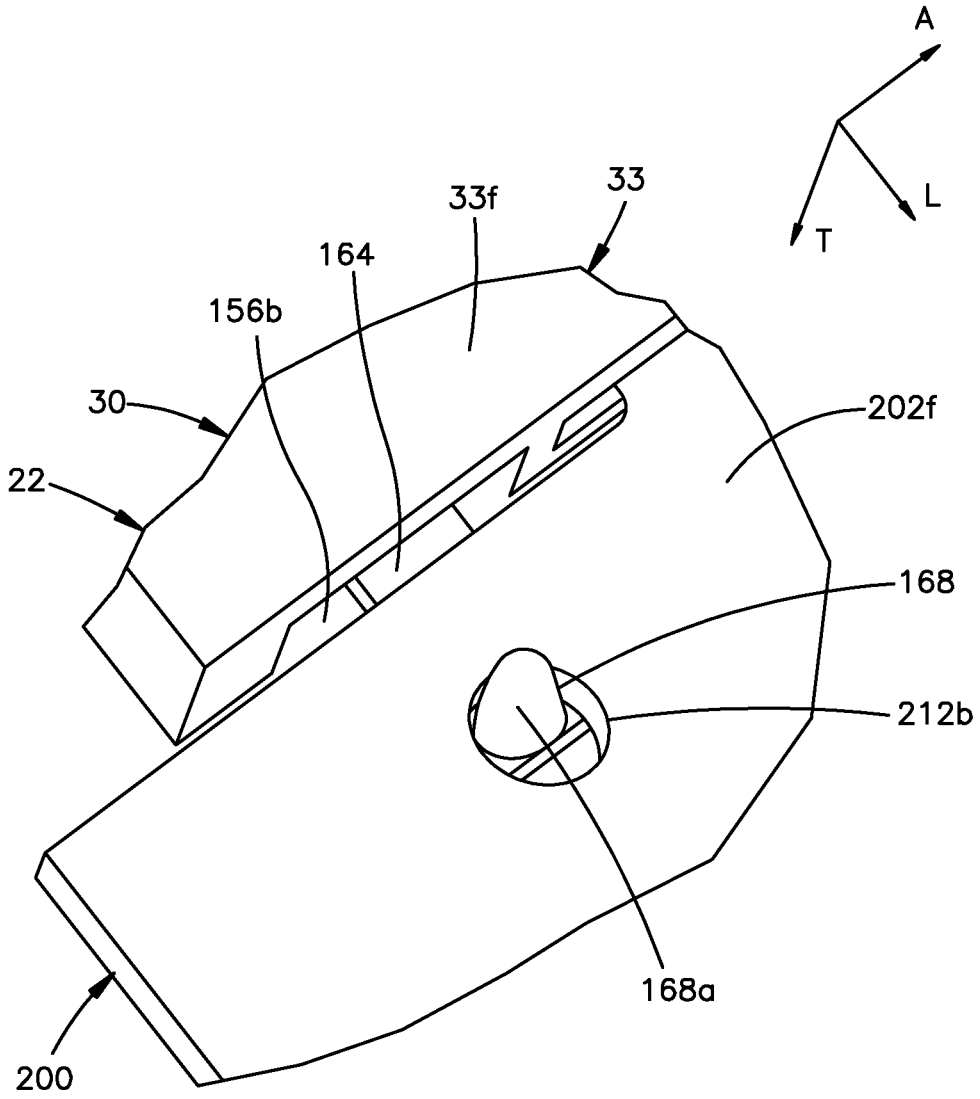
FIG. 4C is a bottom perspective view showing the latch member of the electrical connector attached to the substrate as illustrated in FIG. 4A.

Referring now to FIG. 3, the substrate 200 can be configured as a printed circuit board. The substrate 200 includes a substrate body 202 that defines a front or leading edge 202*a* an opposed rear or trailing edge 202*b* that is spaced from the leading edge 202*a* along the longitudinal direction L, a first side edge 202*c* and an opposed second side edge 202*d* that is spaced from the first side edge 202*c* along the lateral direction A, and an top surface 202*e* and an opposed bottom surface 202*f* that is spaced from the upper surface 202*e* along the transverse direction T. The first and second side edges 202*c* and 202*d* are connected between the leading edge 202*a* and the trailing edge 202*b*, and the opposed top and bottom surfaces 202*e-f* extend between the leading and trailing edges 202*a-b* and the first and second side edges 202*c-d*. The leading and trailing edges 202*a-b* and the first and second side edges 202*c-d* define an outer perimeter of the substrate body 202. The opposed top and bottom surfaces 202*e-f* can be substantially planar along respective planes defined by the longitudinal and lateral directions L and A, respectively. The leading and trailing edges 202*a-b* extend along the lateral direction A between the first and second side edges 202*c* and 202*d* when the leading edge 202*a* is received by the receptacle 106 of the electrical connector 22. The first and second side edges 202*c* and 202*d* extend along the longitudinal direction L between the leading and trailing edges 202*a-b* when the leading edge 202*a* is received by the receptacle 106 of the electrical connector 22.

The substrate body 202 can be narrowed at the mating interface 205 along the lateral direction A with respect to a remaining portion of the substrate body 202, so as to define a projection region 203 that defines the mating interface 205. The projection region 203 is configured to be inserted into the electrical connector 22. The projection region 203 can define a width along the lateral direction A than is less than that of the remaining portion of the substrate body 202. The substrate body 202 can further define at least one side margin, such as first and second side margins 207*a* and 207*b* that are spaced from each other along the lateral direction A. The first and second side margins 207*a* and 207*b* can be outwardly disposed with respect to the projection region 203 along the lateral direction A, and rearwardly disposed from the projection region 203 along the longitudinal direction. The first and second side margins 207*a* and 207*b* can define the first and second side edges 202*c* and 202*d*, respectively, of the substrate body 202. At least one, such as a plurality of the electrical contact pads 204 can be carried by at least one or both of the top and bottom surfaces 202*e* and 202*f*, such that the electrical contact pads 204 are disposed at the mating interface 205, and arranged substantially parallel to the leading edge 202*a* at a location proximate to the leading edge 202*a* at the projection region 203. Accordingly, when a complementary electrical component, for instance the electrical connector 22, is mated to the substrate 200, the mating ends of electrical contacts of the electrical connector abut the mating interface 205, and in particular the electrical contact pads 204, thereby placing the substrate 200 into electrical communication with the electrical contacts of the electrical connector. Because all of the electrical contact pads 204 can be carried by the projection region 203, neither the first side margin 207*a* nor the second side margin 207*b* is aligned with any of the electrical contact pads 204 along the longitudinal direction L.

The electrical contact pads 204 can include at least one electrical power contact pad 206 such as a plurality of electrical power contact pads 206 and at least one electrical signal contact pad 208 such as a plurality of electrical signal contact pads 208. The mating interface 205 of the illustrated substrate 200 includes nine electrical power contact pads 206 and six electrical signal contact pads 208, carried by each of the top and bottom surfaces 202*e* and 202*f* of the substrate body 202 in a laterally spaced arrangement along the leading edge 202*a*. It should be appreciated that the substrate 200 is not limited to the illustrated arrangement of electrical contact pads 204, and that the substrate 200 can alternatively be constructed with any number of electrical power contact pads 206 and/or electrical signal contact pads 208, in any arrangement. In accordance with alternative embodiments, the substrate 200 can be devoid of electrical signal contact pads 208, such that the plurality of electrical contact pads 204 includes only electrical power contact pads 206. Alternatively still, the substrate 200 can be devoid of electrical power contact pads 206, such that the plurality of electrical contact pads 204 includes only electrical signal contact pads 208.

The substrate body 202 can define a thickness between the top and bottom surfaces 202*e-f* along the transverse direction T that is substantially equal or slightly greater than a distance between the upper and lower retainer arms 85*a* and 85*b* of the power contact retainer 50 (see FIGS. 2A-B). Further, the thickness of the substrate body 202 can be substantially equal to or slightly greater than a distance between the upper and lower retainer arms 111*a* and 111*b* of the signal contact retainer 56 (see FIGS. 2C-D). Accordingly, when the substrate 200 is inserted into the housing body 33 of the electrical connector, the mating interface 205 of the substrate 200 is received between the upper and lower retainer arms 85*a* and 85*b*, and between the upper and lower retainer arms 111*a* and 111*b*, which can deflect to provide a normal force against the electrical power contact pads 206 and the electrical signal contact pads 208. Thus, the electrical signal contact pads 208 contact the upper and lower mating ends 41*a* and 41*b* of the electrical signal contacts 40, thereby placing the electrical signal contacts 40 in electrical communication with the electrical signal contact pads 208, and the electrical power contact pads 206 contact the mating ends 45 of the electrical power contacts 42, thereby placing the electrical power contacts 42 in electrical communication with the electrical power contact pads 206.

Referring now to FIGS. 1A-B and FIGS. 3-4C, and as described above, the electrical connector assembly 20 can include an attachment assembly 74 that includes at least one attachment member, such as the first and second attachment members 154*a-b*, of the electrical connector 22, and at least one attachment member, for instance the first and second attachment members 211*a-b*, of the substrate 200. Each of the first and second attachment members 211*a-b* is configured to releasably engage with a respective complementary one of the first and second attachment members 154*a-b* of the electrical connector 22, which are described in more detail below. In accordance with the illustrated embodiment, the first and second attachment members 211*a-b* are configured as first and second apertures 212*a* and 212*b*, respectively, that extend through the substrate body 202 along a transverse direction T from the top surface 202*e* through the bottom surface 202*f*. The first and second apertures 212*a* and 212*b* can be defined by at least one respective first and second inner surface 213*a* and 213*b* of the substrate body 202. The first and second inner surfaces can extend from the top surface 202*e* to the bottom surface 202*f*. The first aperture 212*a* can be disposed adjacent the first side edge 202*c* and the second aperture 212*b* can be disposed adjacent the second side edge 202*d*. The first and second apertures 212*a-b* can further be disposed at the first and second side margins 207*a-b*, respectively. Accordingly, the first and second apertures 212*a-b* are not aligned with any of the electrical contact pads 204 along the longitudinal direction L, and are further not aligned with the projection region 203 along the longitudinal direction L. Thus, the first and second apertures 212*a-b* are not aligned along the longitudinal direction L with a region of the substrate body 202 that 1) is defined by and between the outermost ones of the electrical contact pads 204 with respect to the lateral direction A, and 2) extends from the leading edge 202*a* to the trailing edge 202*b*.

The first and second apertures 212*a-b* can be substantially cylindrical as illustrated, though it should appreciated that the substrate 200 is not limited to the illustrated first and second apertures 212*a-b*, and that the first and second apertures 212*a-b* can have any other geometry as desired. Furthermore, while the first and second attachment members 211*a-b* are configured as respective first and second apertures 212*a-b* in accordance with the illustrated embodiment, it should be appreciated that the first and second attachment members 211*a-b* can be alternatively configured as desired to attach to the first and second attachment members 154*a-b*, respectively, so as to attach the substrate 200 to the electrical connector 22 when the electrical connector 22 mates with the substrate 200 in the manner described herein.

Referring now to FIGS. 1A-B and FIGS. 4A-C, the electrical connector 22 can include at least one attachment member such as a first attachment member 154*a* and a second attachment member 154*b* that are supported by the housing body 33 and configured to releasably secure the electrical connector 22 to a complementary electrical component, such as the substrate 200. In accordance with the illustrated embodiment, the connector housing 30 defines at least one pocket, and the at least one attachment member is at least partially disposed in the at least one pocket. For instance, the connector housing 30 includes a first pocket 156*a* and a second pocket 156*b* that each extend into the housing body 33, for instance down into the top end 33*e* of the housing body 33 along the transverse direction T and rearward into the front end 33*a* of the housing body along the longitudinal direction L. The first pocket 156*a* can be disposed between the electrical contacts 38, and in particular the electrical power contacts 42, and the first side 33*c* of the housing body 33. The second pocket 156*b* can be disposed between the electrical contacts 38, and in particular the electrical signal contacts 40, and the second side 33*d* of the housing body 33. Thus, all of the electrical contacts 38 can be disposed between the first and second pockets 156*a-b* along the lateral direction A, and thus also between the first and second attachment members 154*a-b* along the lateral direction A.

Each of the first and second pockets 156*a* can be at least partially defined by a respective base 157 of the housing body 33 that is disposed below the top end 33*e* of the housing body 33, for instance between the bottom end 33*f* and the top end 33*e*. Each base 157 can be substantially parallel to each of the bottom end 33*f* and the top end 33*e*, and defines a bottom boundary of the respective first and second pockets 156*a-b*. Each of the first and second pockets 156*a-b* can be further at least partially defined by a respective pair of opposed side walls 159 that are spaced from each other along the lateral direction A, and extend from the respective base 157, for instance up along the transverse direction T from the base 157 to the top end 33*e* of the housing body 33. The side walls 159 at least partially define the side boundaries of the first and second pocket 156*a-b*, respectively, with respect to the lateral direction A. Each of the first and second pockets 156*a* can be further at least partially defined by a rear wall 161 that extends between the respective opposed side walls 159 along the lateral direction A, and further extends up from the respective base 157 along the transverse direction T to the top end 33*e* of the housing body 33. The rear wall 161 can define a rear boundary of the respective first and second pockets 156*a-b* with respect to the longitudinal direction L. The first and second pockets 156*a-b* can each further define an open front end 163 that is open to the front end 33*a* of the housing body 33, and an open top end 165 that is open to the top end 33*e* of the housing body 33.

In accordance with the illustrated embodiment, the at least one attachment member of the electrical connector 22 can be configured as at least one latch member. For instance, each of the first and second attachment members 154*a-b* can be configured as first and second latch members 158*a-b*, respectively, though it should be appreciated that the first and second attachment members 154*a-b* can be alternatively constructed as desired. Each of the first and second latch members 158*a-b* includes a latch body 160 and a pivot member 162 that is carried by the latch body 160. The latch body 160 further includes a latch arm 164 that extends substantially forward from the pivot member 162 along the longitudinal direction L, and a handle member 166 that extends substantially rearward from the pivot member 162 along the longitudinal direction L.

The pivot member 162 can be integral and monolithic with the latch body 160, or can be separate from and attached to the latch body 160. For instance, the pivot member 162 can be configured as a pin that extends through the latch body 160. The handle member 166 can define a textured upper grip surface that facilitates ergonomic engagement by opposed thumbs or fingers of a user when actuating the first and second latch members 158*a-b* as described in more detail below. The pivot members 162 can extend out from the latch body 160 along the lateral direction A into apertures 112 that extend into one or both of the opposed side walls 159. Thus, the first and second latch members 158*a-b* can be at least partially disposed in the respective first and second pockets 156*a-b*. The pivot members 162 are rotatable in the respective apertures about a pivot axis P that extends along the lateral direction A, such that the latch body 160 can pivot about the pivot axis P. Thus, it can be said that the first and second latch members 158*a-b* are pivotally attached to at least one or both of the respective first and second side walls 159*a-b*. The latch members 158*a-b* can pivot about the respective pivot axis P in respective attachment directions from respective detachment positions to respective attachment directions, and in respective detachment directions from respective attachment positions to respective detachment directions. The pivot axes P can be disposed at respective locations that are spaced rearward from the front end 33*a* of the housing body 33. Furthermore, the pivot axis P of the first latch member 158*a* can be aligned with the pivot axis P of the second latch member 158*b*. The illustrated pivot members 162 are substantially cylindrically shaped, but any other suitable pivot member geometry can be used as desired.

As is described in more detail below, each of the first and second latch members 158*a-b*, and in particular each latch body 160, is pivotable about the pivot member 162, and thus is pivotable about the respective pivot axis P, in 1) a first attachment direction which is configured to attach the respective first and second latch members 158*a-b* to the respective first and second attachment members 211*a-b* of the substrate 200, and 2) a second detachment direction that is opposite the attachment direction, which is configured to detach the respective first and second latch members 158*a-b* from the respective first and second attachment members 211*a-b* of the substrate 200. It should be appreciated that the pivot axis P can extend along the lateral direction A, and thus perpendicular to the mating direction M (see FIG. 1B).

The latch arm 164 extends forward from the pivot member 162 along the longitudinal direction L, and defines an inner end 164*a* that is disposed proximate to the pivot member 162 and an opposed outer end 164*b* that can extend forward from the inner end 164*a* along the longitudinal direction L, and thus extend forward from the pivot member 162 along the longitudinal direction L. The outer end 164*b* can further be spaced from the inner end 164*a* along the mating direction M, and can extend forward from the front end 33*a* of the housing body 33. Each latch body 160 of the first and second latch members 158*a-b* can include a lock member such as a barb 168 that is configured to releasably engage with an engagement member of a complementary electrical component, for instance the respective first and second apertures 212*a-b* of the substrate 200, so as to attach the connector housing 30 to the substrate 200. The barb 168 is thus spaced from the front end 33*a* of the housing body 33 along the mating direction.

The barb 168 is configured to move into the respective one of the first and second apertures 212*a-b* of the substrate 200. The barb 168 can be shaped as desired, and extends down from the outer end 164*b* of the latch arm 164, and defines a leading engagement surface 168*a* that can be beveled and extend down along the transverse direction T and rearward along the longitudinal direction L from the outer end 164*b*. The leading engagement surface 168*a* is configured to abut and cam up along the transverse direction T over the leading edge 202*a* of the substrate 200, such that the barb 168 rides along the top surface 202*e* of the substrate 200 as the electrical connector is mated with the substrate 200. The barb 168 further defines a trailing engagement surface 168*b* that is opposite the leading engagement surface 168*a* and rearwardly spaced from the leading engagement surface 168*a* along the longitudinal direction L. The trailing engagement surface 168*b* is further angularly offset with respect to the leading engagement surface. Thus, the leading engagement surface 168*a* is spaced from the trailing engagement surface 168*b* in the mating direction M.

The handle member 166 extends rearward from the pivot member 162 along the longitudinal direction L, and defines an inner end 166*a* that is disposed proximate to the pivot member 162, and an opposed outer end 166*b* that can extend rearward from the inner end 166*a* along the longitudinal direction L, and thus extend rearward from the pivot member 162 along the longitudinal direction L. Each of the first and second latch members 158*a-b* can include a resilient spring member 170 that extends from the latch body 160, for instance from handle member 166, such as from the outer end 166*b* of the handle member 166 toward the housing body 33, for instance toward the base 157. Thus, the pivot location 162 is disposed between the barb 168 and the spring member 170. The spring member 170 can be configured as a resilient and flexible arm having a portion that is spaced from the handle member 166, for instance below the handle member 166 along the transverse direction T. The spring member 170 is configured to abut and resiliently compress against the housing body 33, for instance at the base 157, as the latch body 160 pivots in the detachment direction about the pivot axis P, which causes the handle member 166 to move in a first direction, such as down along the transverse direction T, and causes the latch arm 164 and thus the barb 168 to move in an opposed second direction, such as up along the transverse direction T. It should be appreciated that when the spring member 170 is compressed against the housing body 33, the spring member 170 applies a biasing force to the handle member 166 that biases the handle member 166 to travel in the second direction, which thereby biases the latch body 160 to pivot about the pivot axis P in the attachment direction, latch arm 164 and thus the barb 168 travel in the first direction.

During operation, when the electrical connector 22 is mated to the substrate 200, the mating interface 26 of the electrical connector is aligned with the mating interface 205 of the substrate 200 such that the relative movement between the electrical connector 22 and the substrate 200 along the mating direction M causes the leading edge 202*a* of the substrate body 202 to be inserted into the receptacle 106. As the mating interfaces 26 and 205 are coupled to each other, the mating ends of the electrical contacts 38, of each of the upper and lower rows 61*a* and 61*b*, respectively, abut the complementary electrical contact pads 204 that are carried by at least one or both of the top and bottom surfaces 202*e* and 202*f* of the substrate 200. For instance, the mating ends of the electrical signal contacts 40 can abut the complementary electrical signal contact pads 208 that are carried by one or both of the top and bottom surfaces 202*e* and 202*f*, thereby placing the substrate 200 in electrical communication with the electrical connector 22. Similarly, the mating end of the electrical power contacts 42 can abut the complementary electrical power contact pads 206 that are carried by the one or both of the top and bottom surfaces 202*e* and 202*f*.

When the electrical connector 22 is aligned with the substrate 200 for mating, the leading engagement surfaces 168*a* can be aligned with the leading edge 202*a* of the substrate 200 with respect to the mating direction M when the latch members 158*a-b* are in a first or initial position. As the electrical connector 22 is thus mated with the substrate 200 such that the receptacle 106 receives the substrate 200, the leading engagement surfaces 168*a* can cam over the leading edge 202*a* of the substrate 200 and onto the top surface 202*e* of the substrate body 202 as described above. Because the barbs 168 are spaced above the respective first and second apertures 212*a-b*, the first and second latch members 158*a-b* can be said to be in a detachment position. It should be appreciated that as the leading engagement surfaces 168*a*, and thus the arm members 164, translate up along the transverse direction T as they cam over the leading edge 202*a* of the substrate 200, the latch arms 164 pivot along the detachment direction, which causes the spring members 170 to compress against the housing body 33. The compression of the spring members 170 against the housing body 33 causes the spring members 170 to apply a biasing force against the handle members 166 that biases the latch bodies 160 to pivot about the pivot axis P in the attachment direction. However, mechanical interference between the substrate body 202 and the barbs 168 prevents the latch bodies 160 from pivoting in the attachment direction. The barbs 168 continue to ride along the top surface 202*e* until the substrate 200 is fully received in the receptacle 106, such that the mating ends 39 of the electrical contacts 38 contact the electrical contact pads 204 of the substrate 200 in the manner described above. When the substrate 200 is fully received in the receptacle 106, the barbs 168 become aligned with the complementary first and second apertures 212*a-b*, respectively, such that the spring force biases the latch members 158*a-b* to the attachment position whereby the barbs 168 are inserted into the respective apertures 212*a-b*.

Once both the leading engagement surfaces 168*a* and the trailing engagement surfaces 168*b* are aligned with the respective first and second apertures 212*a* and 212*b*, the biasing force of the spring members 170 drives the latch bodies 160 to pivot about the pivot axis P in the attachment direction, which causes the barbs 168 to move into the respective first and second apertures 212*a-b*, whereby the first and second latch members 158*a-b* are in the attachment position. Because the trailing engagement surfaces 168*b* are aligned with the respective first and second inner surfaces 213*a-b* along the longitudinal direction, mechanical interference between the trailing engagement surfaces 168*b* and the respective inner surfaces 213*a-b* limit or prevent movement of the substrate 200 away from the electrical connector 22 along the longitudinal direction L opposite the mating direction. Thus, engagement between the first and second attachment members 154*a-b* of the electrical connector 22 and the first and second attachment members 211*a-b* of the substrate 200 secures the substrate 200 to the electrical connector 22 after the electrical connector 22 has been mated to the substrate 200.

In accordance with an alternative embodiment, when the electrical connector 22 is aligned with the substrate 200 for mating, a user can apply a downward force against the handle members 166 along the transverse direction T against the biasing force of the spring members 170, which causes the first and second latch members 158*a-b* to move, such as pivot, in the detachment direction from the first position to the detachment position, whereby the leading engagement surfaces 168*a*, and an entirety of the barbs 168, are removed from alignment with the substrate body 202. For instance, the entirety of the barbs 168 can be spaced above the substrate body 202 along the transverse direction T, such that the electrical connector 22 can mate with the substrate 200 until the substrate 200 is fully received in the receptacle 106, such that the mating ends 39 of the electrical contacts 38 contact the electrical contact pads 204 of the substrate 200 in the manner described above, without bringing the engagement surfaces 168*a* into contact with the substrate 200. As the first and second latch members 158*a-b* move in the detachment direction, the spring members 170 compress against the housing body 33, thereby biasing the first and second latch members 158*a-b* to move in the attachment direction. Accordingly, when the substrate 200 is fully received in the receptacle 106, the barbs 168 become aligned with the complementary first and second apertures 212*a-b*, respectively. The applied force can be removed from the handle members 166, which causes the biasing force of the spring members 170 to actuate the first and second latch members to move in the attachment direction to the respective attachment positions, whereby the barbs 168 are inserted into the respective first and second apertures 212*a-b*.

When it is desired to unmate the substrate 200 from the electrical connector 22, the first and second latch members 158*a-b* can be actuated to remove the barbs 168 from the respective first and second apertures 212*a-b* of substrate 200. For instance, the handle members 166 can be depressed down along the transverse direction T into the respective first and second pockets 156*a-b* toward the housing body 33, for instance toward the base 157 against the biasing force of the spring member 170, which causes the latch bodies 160 to pivot about the respective pivot axes P in the detachment direction, such that the respective latch arms 164, and thus the barbs 168, move up along the transverse direction T out of the respective first and second apertures 212*a-b*, thereby removing the mechanical interference between the first and second inner surfaces 213*a-b* and the respective trailing engagement surfaces 168*b*. The substrate 200 can then be disengaged from the electrical connector 22 by moving one or both of the substrate 200 and the electrical connector 22 away from the other along a direction opposite the mating direction M.

It should be appreciated that when the barbs 168 are disposed in the respective first and second apertures 212*a-b*, such that the latch members 158*a-b* are in respective attachment positions, at least a portion, for instance at least the outer end 166*b*, of the handle members 166 are spaced above the top end 33*e* of the housing body 33. In accordance with one embodiment, each of the first and second latch members 158*a-b* can be actuated to a respective detachment position from the attachment position. For instance, the handle members 166 can be depressed until the outer ends 166*b* are at least substantially flush with, or disposed below, the top end 33*e* of the housing body 33, which causes the barbs 168 to be removed from the respective first and second apertures 212*a-b*. It should be appreciated, however, that the first and second latch members 158*a-b* can be constructed as desired, so as to adjust the amount of movement of the handle members 166 that causes the barbs 168 to be removed from the respective first and second apertures 212*a-b*.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical cable connector configured to be mated to a substrate along a mating direction, the electrical cable connector comprising:

a connector housing defining a housing body that has a front end that defines a mating interface, the connector housing further defining a receptacle that extends into the front end so as to at least partially define the mating interface, wherein the receptacle is elongate along a lateral direction that is perpendicular to the mating direction, the receptacle is sized to receive a front edge of the substrate, and the connector housing defines a pocket that extends into the housing body and defines a base that at least partially defines the pocket;

a plurality of electrical contacts carried by the connector housing, the electrical contacts defining mating ends that are configured to electrically connect to electrical contact pads carried by at least one of top and bottom surfaces of the substrate when the mating interface receives the substrate, the electrical contacts defining mounting ends that are disposed opposite the mating ends and are configured to electrically connect to respective cables; and at least one latch member at least partially disposed in the pocket, the latch member including a latch arm that carries a lock member, the latch member pivotable about a pivot axis in 1) an attachment direction that causes the lock member to move into the aperture when the substrate is fully received in the receptacle, and 2) a detachment direction that removes the lock member from the aperture, wherein the at least one latch member further includes a handle and a pivot member disposed between the latch arm and the handle, the pivot member is pivotally mounted to the housing body about the pivot axis, and the pivot axis extends along the lateral direction.

2. The electrical cable connector as recited in claim 1, wherein depressing the handle toward the base causes the at least one latch member to pivot in the detachment direction.

3. The electrical cable connector as recited in claim 2, wherein the at least one latch member comprises a resilient flexible spring member that extends from the handle along toward the base, such that the spring member compresses against the base as the latch member pivots in the detachment direction, the spring member biasing the at least one latch member to pivot in the attachment direction.

4. The electrical cable connector of claim 3, wherein the pocket is a first pocket, and the at least one latch member is a first latch member, the electrical connector further defining a second pocket that extends into the housing body and defines a base and at least one side wall that extends from the base of the second pocket, and a second latch member at least partially disposed in the second pocket, the second latch member including a latch arm that carries a lock member, the second latch member movable in 1) an attachment direction that causes the lock member to move into the aperture when the substrate is fully received in the receptacle, and 2) a detachment direction that removes the lock member from the aperture.

5. The electrical cable connector as recited in claim 4, wherein the second latch member further includes a handle and a pivot member disposed between the latch arm of the second latch member and the handle of the second latch member, and the pivot member of the second latch member is pivotally mounted to the housing body about the pivot axis, such that the second latch member is pivotable about the pivot axis in the attachment direction and the detachment direction.

6. The electrical cable connector as recited in claim 5, wherein all of the plurality of electrical contacts are disposed between the first and second latch members.

7. The electrical cable connector as recited in claim 6, wherein the housing body defines first and second opposed sides, the first latch member is disposed between the first side and the plurality of electrical contacts, and the second latch member is disposed between the second side and the plurality of electrical contacts.

8. The electrical cable connector as recited in claim 1, wherein the housing body further comprises at least one side wall that extends from the base, the at least one side wall further at least partially defining the pocket, and the pivot member is pivotally attached to the at least one side wall.

9. The electrical cable connector as recited in claim 8, wherein the housing body comprises a pair of side walls that extend from the base, each of the pair of side walls at least partially defining the pocket, and the pivot member is pivotally attached to each of the pair of side walls.

10. The electrical cable connector as recited in claim 1, wherein the pivot axis is spaced rearward from the front end of the connector housing, and the latch member is pivotal about the pivot axis.

11. The electrical cable connector as recited in claim 1, wherein the housing body defines a top end and the pocket extends into the top end, and the handle is spaced above the top end when the latch member is in an attached position, such that the lock member is inserted in the aperture when the substrate is fully received in the receptacle.

12. The electrical cable connector as recited in claim 1, wherein the latch arm extends forward from the front end of the housing body such that the lock member is spaced forward from the front end of the housing body along the mating direction.

13. The electrical cable connector as recited in claim 12, wherein the latch arm defines an inner end that is disposed proximate to the pivot member, and an outer end that is spaced in the mating direction from the inner end, and the lock member extends from the outer end of the latch arm.

14. The electrical cable connector as recited in claim 13, wherein the lock member defines a beveled leading engagement surface configured to cam over a leading edge of the substrate as the electrical connector is mated to the substrate.

15. The electrical cable connector as recited in claim 14, wherein the lock member further defines a trailing engagement surface that is further angularly offset with respect to the leading engagement surface, and is configured to mechanically interfere with the substrate so as to limit movement of substrate relative to the electrical connector in a direction opposite the mating direction.

16. The electrical cable connector as recited in claim 1, wherein the electrical contacts comprises a plurality of electrical power contacts and a plurality of electrical signal contacts.

17. The electrical cable connector as recited in claim 16, wherein the electrical power contacts are configured to be mounted to a respective plurality of electrical power cables, and the electrical signal contacts are configured to be mounted to a respective plurality of electrical signal cables.

18. The electrical cable connector as recited in claim 17, wherein the electrical power contacts are configured to mount to the plurality of power cables that each define a first diameter, the electrical signal contacts are configured to mount to the plurality of electrical cables that each define a second diameter, and the second diameter is less than the first diameter.

19. The electrical cable connector as recited in claim 1, wherein the mating ends of the electrical contacts are configured to straddle the substrate when the electrical connector is mated with the substrate.

20. An electrical cable connector configured to be mated to a substrate along a mating direction, the electrical cable connector comprising:

a connector housing defining a housing body that has a front end that defines a mating interface, the housing body further having a top end, the connector housing further defining a receptacle that extends into the front end so as to at least partially define the mating interface, the receptacle sized to receive a front edge of the substrate, wherein the connector housing defines a pocket that extends into the top end of the housing body, and the connector housing further defines a base that at least partially defines the pocket;

a plurality of electrical contacts carried by the connector housing, the electrical contacts defining mating ends that are configured to electrically connect to electrical contact pads carried by at least one of top and bottom surfaces of the substrate when the mating interface receives the substrate, the electrical contacts defining mounting ends that are disposed opposite the mating ends and are configured to electrically connect to respective cables; and at least one latch member at least partially disposed in the pocket, the latch member including a latch arm that carries a lock member, a handle, and a pivot member disposed between the latch arm and the handle, the latch member movable in 1) an attachment direction that causes the lock member to move into the aperture when the substrate is fully received in the receptacle, and 2) a detachment direction that removes the lock member from the aperture, wherein the handle is spaced above the top end when the latch member is in an attached position, such that the lock member is inserted in the aperture when the substrate is fully received in the receptacle, wherein the pivot member is pivotally mounted to the housing body about a pivot axis that is spaced rearward from the front end of the connector housing, and is substantially perpendicular to the mating direction, such that the latch member is pivotable about the pivot axis in the attachment direction and the detachment direction.

21. The electrical cable connector as recited in claim 20, wherein depressing the handle toward the base causes the at least one latch member to pivot about the pivot axis in the detachment direction.

22. The electrical cable connector as recited in claim 21, wherein the at least one latch member comprises a resilient flexible spring member that extends from the handle along toward the base, such that the spring member compresses against the base as the latch member pivots in the detachment direction, the spring member biasing the at least one latch member to pivot in the attachment direction.

23. The electrical cable connector as recited in claim 20, wherein the latch arm extends forward from the front end of the housing body such that the lock member is spaced forward from the front end of the housing body along the mating direction.

* * * * *